US010028578B2

(12) United States Patent
Corless et al.

(10) Patent No.: US 10,028,578 B2
(45) Date of Patent: Jul. 24, 2018

(54) SNAP-IN BRACKET FOR SLIDABLE RACKS AND METHOD OF USE

(71) Applicant: Hardware Resources, Inc., Bossier City, LA (US)

(72) Inventors: Justin Corless, Dallas, TX (US); Dennis McGregor, Farmers Branch, TX (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

(21) Appl. No.: 15/458,718

(22) Filed: Mar. 14, 2017

(65) Prior Publication Data

US 2018/0098624 A1 Apr. 12, 2018

Related U.S. Application Data

(63) Continuation-in-part of application No. 15/291,560, filed on Oct. 12, 2016.

(51) Int. Cl.
*A47B 61/02* (2006.01)
*A47B 96/06* (2006.01)

(52) U.S. Cl.
CPC ..... *A47B 61/02* (2013.01); *A47B 96/067* (2013.01)

(58) Field of Classification Search
CPC ..... A47B 96/067; A47B 61/003; A47B 61/02; F16B 2/22

(Continued)

(56) References Cited

U.S. PATENT DOCUMENTS 724,427 A 4/1903 Bonsall
1,078,715 A * 11/1913 Cherry, Jr. ..... A47B 61/02 190/13 R (Continued)

FOREIGN PATENT DOCUMENTS

AU 709818 B2 8/1997
CA 1223555 A 6/1987

(Continued)

OTHER PUBLICATIONS

Art eStuff.com, "New Hanging & Lighting, Hanging & Lighting, Wall System," http://ww.artestuff.com/index/php?cPath=163_162, accessed Oct. 2015, 4 pages.

(Continued)

*Primary Examiner* — Ko H Chan
(74) *Attorney, Agent, or Firm* — Schultz & Associates, P.C.

(57) ABSTRACT

A snap-in mounting bracket with a generally "U" shaped cross-section. A set of mounting holes are spaced along the web of the bracket and correspond to existing holes in prefabricated cabinets or closets over a range of industry standard sizes. A guide flange extends from the web proximate the middle of a first edge. End flanges curve around the ends of the first edge. A pair of spring flanges extend from the web on a second edge opposite the middle guide flange. A universal slide assembly is removably secured to the mounting bracket between the flanges. The end flanges and the spring tension of the spring flanges hold the slide assembly in place. Different closet organizer components such as tie racks, pant racks, and belt racks can be affixed to the slide assembly for slidable deployment along the vertical partition out of the closet.

20 Claims, 16 Drawing Sheets

(58) Field of Classification Search
USPC ..... 211/85.3
See application file for complete search history.

(56) References Cited

U.S. PATENT DOCUMENTS

| | | | | |
|---|---|---|---|---|
| 1,574,705 | A * | 2/1926 | Sessions | A47B 61/003 211/94.02 |
| 2,102,405 | A | 12/1937 | Coggiola | |
| 2,754,974 | A | 7/1956 | Larson | |
| 3,172,540 | A | 3/1965 | Berge | |
| 3,239,182 | A | 3/1966 | Blanz | |
| 3,756,637 | A | 9/1973 | Wildi | |
| 3,985,325 | A * | 10/1976 | Ginsburg | A47F 5/0823 248/220.22 |
| 4,022,415 | A * | 5/1977 | Roderick | A47H 19/00 160/349.2 |
| 4,320,935 | A | 3/1982 | Nagelkirk | |
| 4,763,579 | A | 8/1988 | Cibulak | |
| 4,995,323 | A | 2/1991 | Kellems | |
| 5,332,108 | A | 7/1994 | Blass | |
| 5,482,168 | A | 1/1996 | Welch et al. | |
| 5,718,493 | A | 2/1998 | Nikolai | |
| 6,230,903 | B1 * | 5/2001 | Abbott | A47B 88/43 211/190 |
| 6,669,157 | B1 * | 12/2003 | Willin | A47K 10/185 248/311.2 |
| 6,871,749 | B2 | 3/2005 | Bostick et al. | |
| 6,932,225 | B2 | 8/2005 | Rowe | |
| 6,935,519 | B2 | 8/2005 | Lawson et al. | |
| 7,861,901 | B2 | 1/2011 | Kirschbaum | |
| 7,900,781 | B2 | 3/2011 | Baine et al. | |
| 8,066,237 | B2 * | 11/2011 | Tyner | A47F 1/04 211/85.17 |
| 8,302,786 | B2 | 11/2012 | Kao | |
| 9,545,153 | B2 * | 1/2017 | Chen | H05K 7/1489 |
| 2011/0088332 | A1 | 4/2011 | Allis et al. | |
| 2011/0147551 | A1 | 6/2011 | Richard et al. | |
| 2014/0111073 | A1 | 4/2014 | Kunis | |
| 2014/0291467 | A1 * | 10/2014 | Yang | A47B 61/02 248/424 |
| 2015/0027972 | A1 | 1/2015 | Andersson et al. | |

FOREIGN PATENT DOCUMENTS

| | | | |
|---|---|---|---|
| EP | 1029480 | A1 | 8/2000 |
| GB | 1362547 | A | 8/1974 |

OTHER PUBLICATIONS

Clip Rail, "Installation Instructions," Peak Rock Ltd, white 2m (6ft 6) [RC-W-200], Picture Hanging, picturehanging.com, accessed: Oct. 2015, 1 page.

Houzz, houzz.com, Rail Anchor Pot and Pan Rack, Wall Mounted—Industrial—Pot Racks and Accessories—by Railroadware, http://www.houzz.com/photos/11800582/Rail-Anchor-Pot-and-Pan-Rack-Wall-Mounted-industrial-pot-racks-and-accessories, accessed: Oct. 2015, 3 pages.

* cited by examiner

SNAP-IN BRACKET FOR SLIDABLE RACKS AND METHOD OF USE

CROSS-REFERENCE TO RELATED APPLICATIONS

This application is a continuation in part of application Ser. No. 15/291,560 filed Oct. 12, 2016. The patent application identified above is incorporated herein by reference in its entirety to provide continuity of disclosure.

FIELD OF THE DISCLOSURE

This disclosure relates to mounting brackets. In particular, the disclosure relates to a snap-in bracket for attaching slide rail assemblies to a partition for closet organization applications.

BACKGROUND OF THE DISCLOSURE

Prefabricated closet panels include pre-drilled mounting holes for the attachment of closet organizer components such as clothing racks and shelving systems. Different panels can include differently spaced mounting holes. Similarly, different components can have differently space mounting holes. As a result, an installer is sometimes forced to drill additional holes in the closet panels to align with the mounting holes of other panels or components in order to mount them to the closet panel.

The prior art presents a multitude of movable racks for installation on the closet panels.

For example, U.S. Pat. No. 6,935,519 to Lawson, et al. discloses a pants/skirts closet rack apparatus adaptable to be installed horizontally into a closet receptacle. The apparatus comprises right and left attachments affixed to slide assemblies directly mounted to the spaced vertical walls of the closet receptacle. Front and back tubular elements connect between the right and left attachments and hangers rest on the tubular elements.

U.S. Pat. No. 6,871,749 to Bostick, et al. discloses a valet rack assembly comprising a three-piece slide assembly having a base rail installed directly on a closet sidewall, an intermediate rail connected to the base rail, an outer housing member slidably coupled to the intermediate rail. An apparel support member in the form of a tie clasp or belt post is slidably coupled to the outer housing member.

The prior art has failed to devise a way to quickly and economically match various hole patterns between closet panels and closet components. Therefore, a need exists for a mounting bracket that can be mounted to a closet panel using any pre-drilled mounting hole pattern and that does not require the drilling of additional mounting holes. There is also a need for a mounting bracket having modular capability where different styles of closet organizer components may be interchangeably attached. There is also a need for a mounting bracket that is capable of being manufactured in different sizes for different closet organizer components while still accommodating the different pre-drilled mounting hole patterns.

SUMMARY

The device disclosed provides for a "snap-in" installation of a slide rail assembly with no requirement for a particular pre-drilled hole pattern. In one preferred embodiment, a mounting bracket is provided with a generally "C" shaped cross-section comprising flanges extending from a web. A set of mounting holes are spaced along the web and correspond to many existing hole patterns over a range of industry standard sizes. A guide flange extends from one edge of the web proximate the middle of the bracket. End flanges extend from the same edge of the web at each end of the bracket. A pair of spring flanges extend from the opposite edge of the web across from the guide flange.

In use, the device is mounted to a partition of a prefabricated closet with typical mounting hardware such as wood screws through the set of mounting holes aligned with preexisting mounting holes in the vertical partition. The outer slide of a slide assembly is positioned between the end flanges, pressed under the guide flange, and snapped into place against the tension of the spring flanges. The web of the outer slide is positioned adjacent the web of the bracket. The end flanges and the spring tension of the spring flanges hold the slide assembly in place. Different closet organizer components can be interchangeably affixed to the slide assembly.

BRIEF DESCRIPTION OF THE DRAWINGS

Reference will now be made to the drawings. In the descriptions that follow, like parts are marked throughout the specification and drawings with the same numerals. The drawing figures are not necessarily drawn to scale and certain figures may be shown in exaggerated or generalized form in the interest of clarity and conciseness.

DETAILED DESCRIPTION

Figure 1:
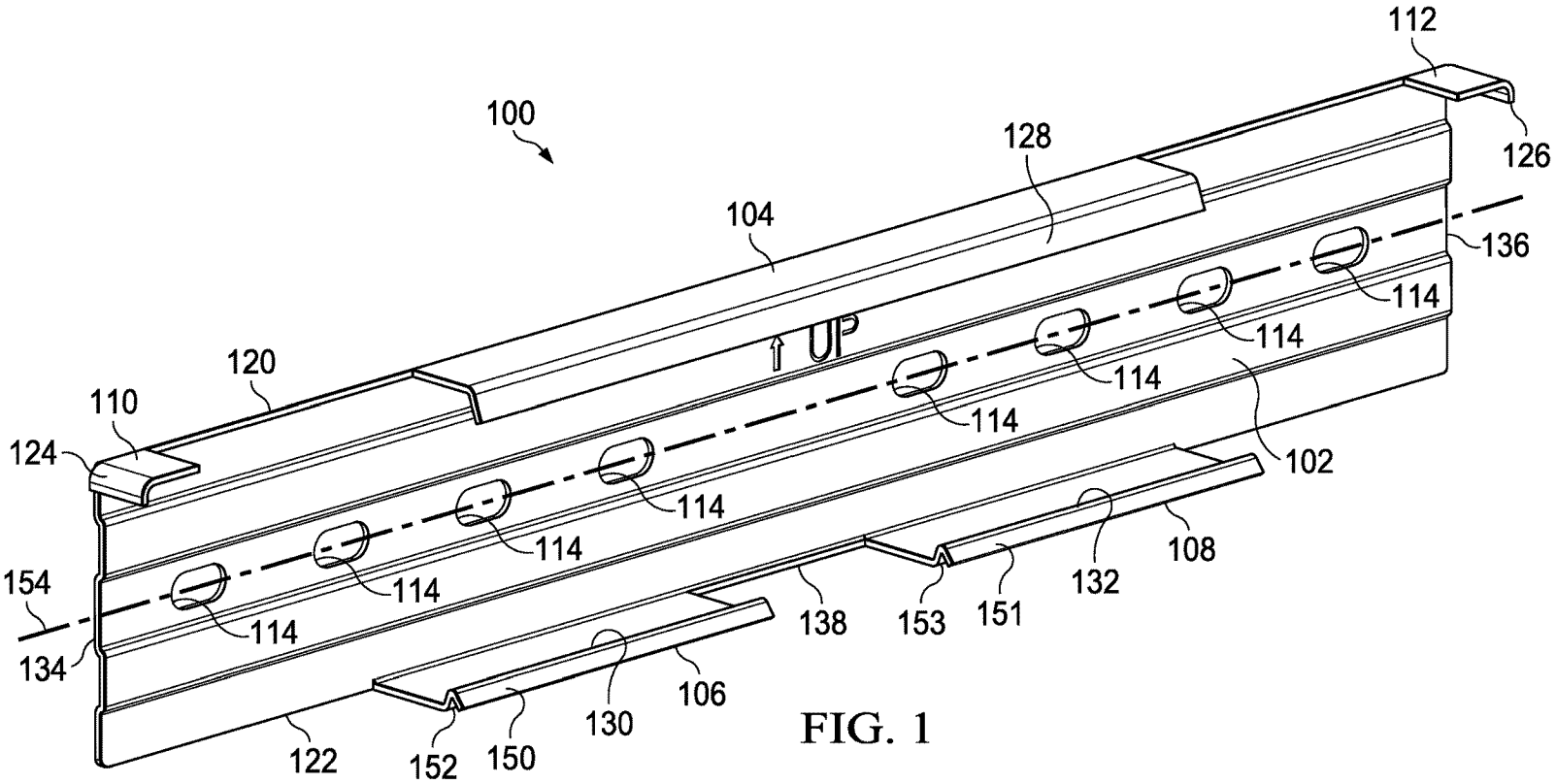
FIG. 1 is an isometric view of a preferred embodiment of a mounting bracket.
Figure 2:
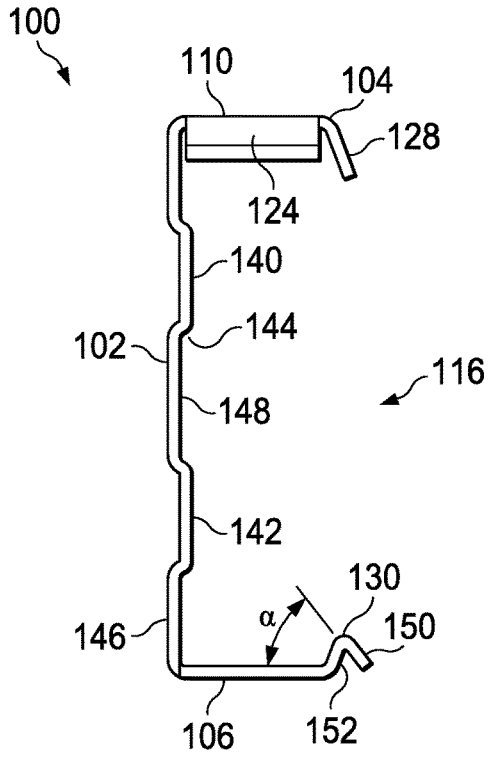
FIG. 2 is a cross-section view of a preferred embodiment of a mounting bracket.

Referring to FIGS. 1 and 2, bracket 100 has a generally "C" shaped cross-section comprised of guide flange 104, end flanges 110 and 112, and spring flanges 106 and 108 extending from web 102. The combination of the flanges and web define interior 116. Web 102 has side 144, adjacent interior 116, and side 146. Between edges 120 and 122, web 102 further includes ridges 140 and 142 which run the length of bracket 100 and extend toward interior 116 from side 144. Positioned between ridges 140 and 142 is recess 148. Mounting holes 114 are oblong shaped and located within recess 148. The longitudinal axes of the mounting holes are parallel to longitudinal axis 154 of the bracket. Mounting holes 114 are evenly spaced along the length of bracket 100 and pass through web 102 between sides 144 and 146. In an alternate embodiment, mounting holes 114 are circular.

Guide flange 104 extends from the proximate middle of edge 120. As oriented in the figures, edge 120 is the upper edge of bracket 100 while edge 122 is the lower edge. End flanges 110 and 112 extend from edge 120 at ends 134 and 136 of bracket 100, respectively. Spring flanges 106 and 108 extend from edge 122 and define gap 138 between the spring flanges. In an alternate embodiment, the guide flange and the end flanges extend from the lower edge while the spring flanges extend from the upper edge. In another alternate embodiment, spring flanges 106 and 108 are combined into one spring flange.

Guide flange 104 extends generally perpendicularly from web 102 and terminates with hook 128 directed toward interior 116. End flange 110 extends generally perpendicularly from web 102 and includes hook 124 which curves around end 134. End flange 112 extends generally perpendicularly from web 102 and includes hook 126 which curves around end 136. Spring flanges 106 and 108 extend generally perpendicularly from web 102 and terminate in bent sections 130 and 132, respectively. Bent section 130 includes abutment surface 150 and holding surface 152. Bent section 132 includes abutment surface 151 and holding surface 153. Abutment surfaces 150 and 151 are oriented at angle $\alpha$ from spring flanges 106 and 108, respectively. Angle $\alpha$ is generally between 30° and 60°, however other angles are envisioned.

Figure 3:
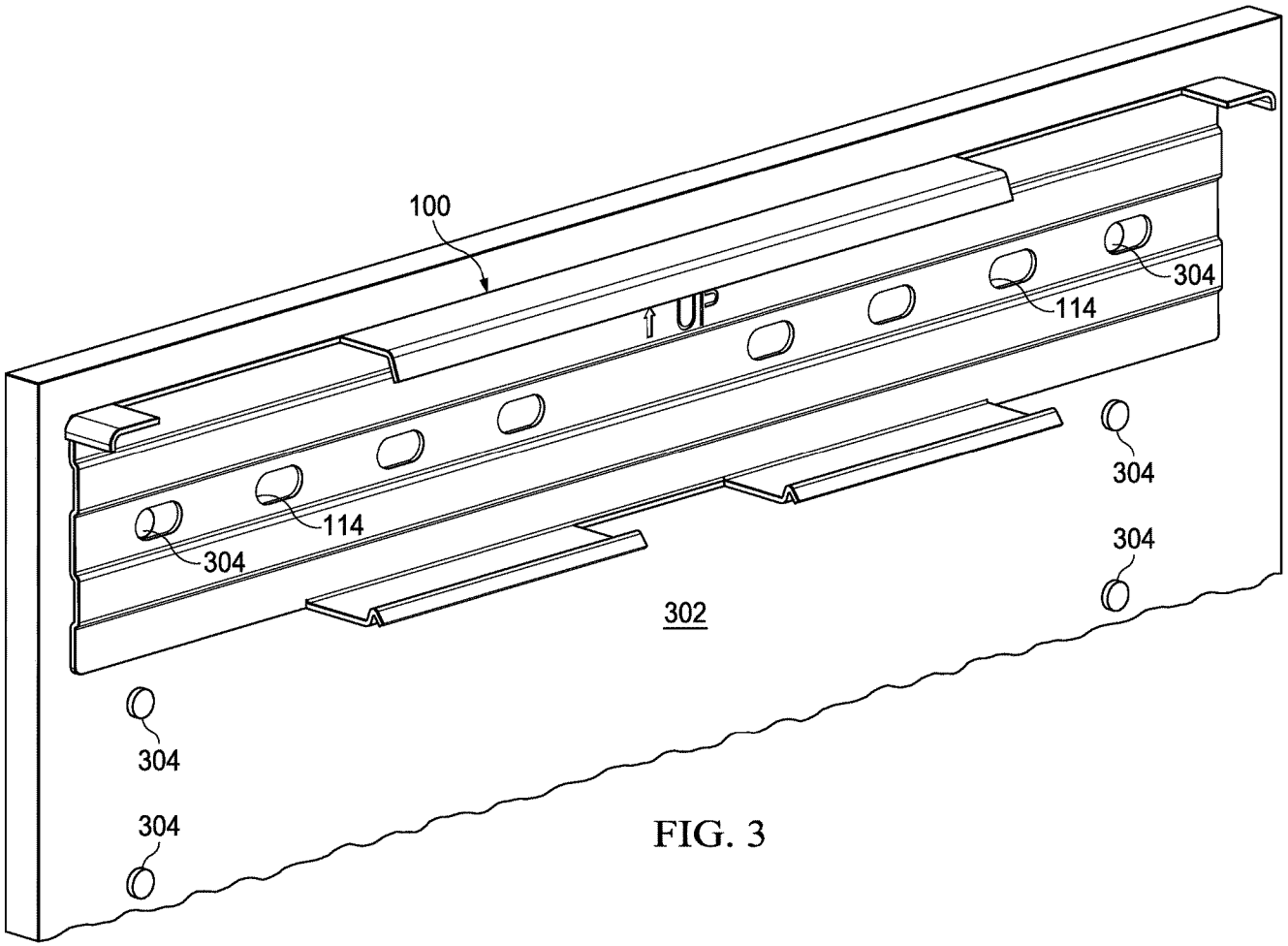
FIG. 3 is an isometric view of a preferred embodiment of a mounting bracket attached to a closet partition.
Figure 5A:
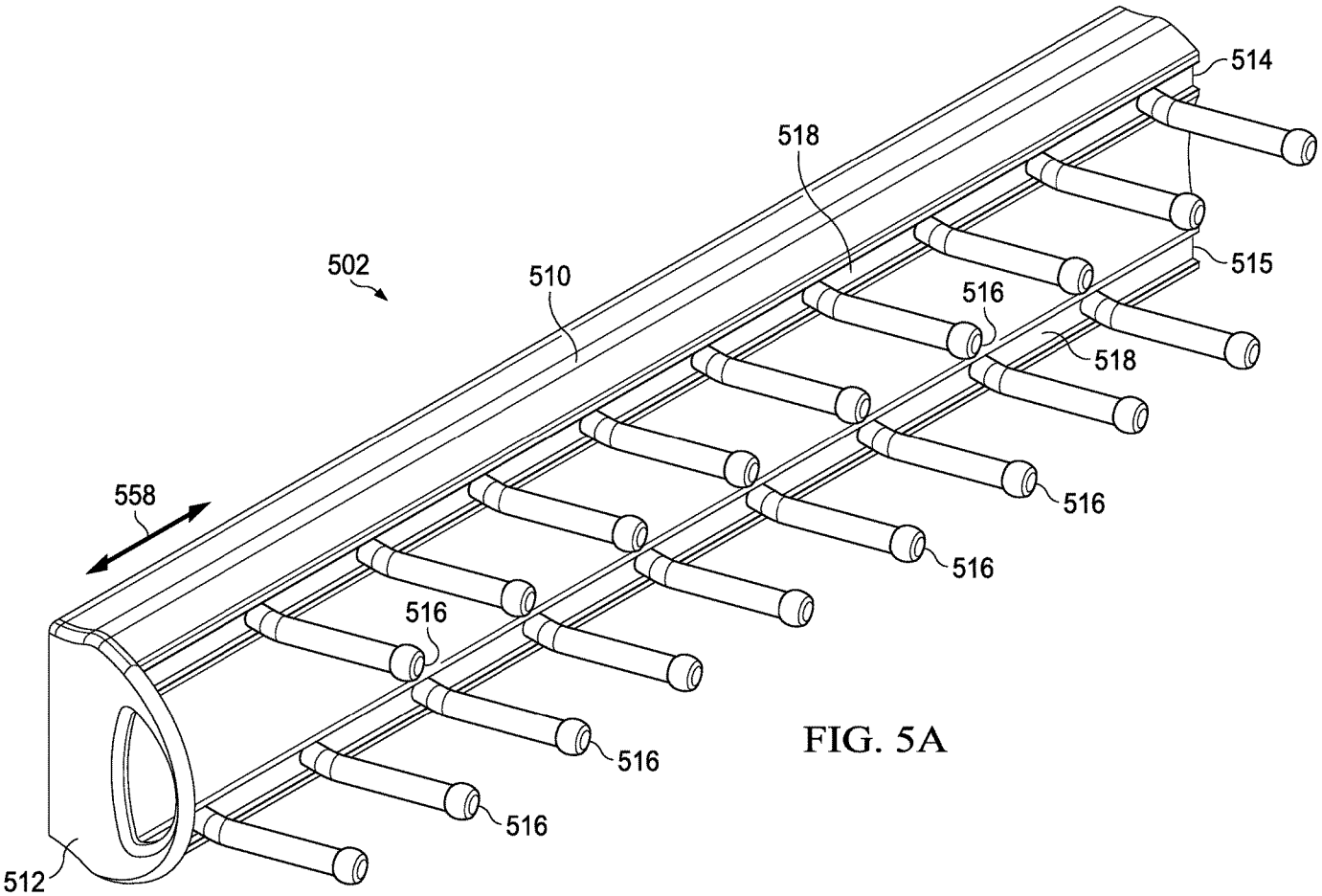
FIG. 5A is an isometric view of a tie rack attached to a slide assembly.
Figure 5B:
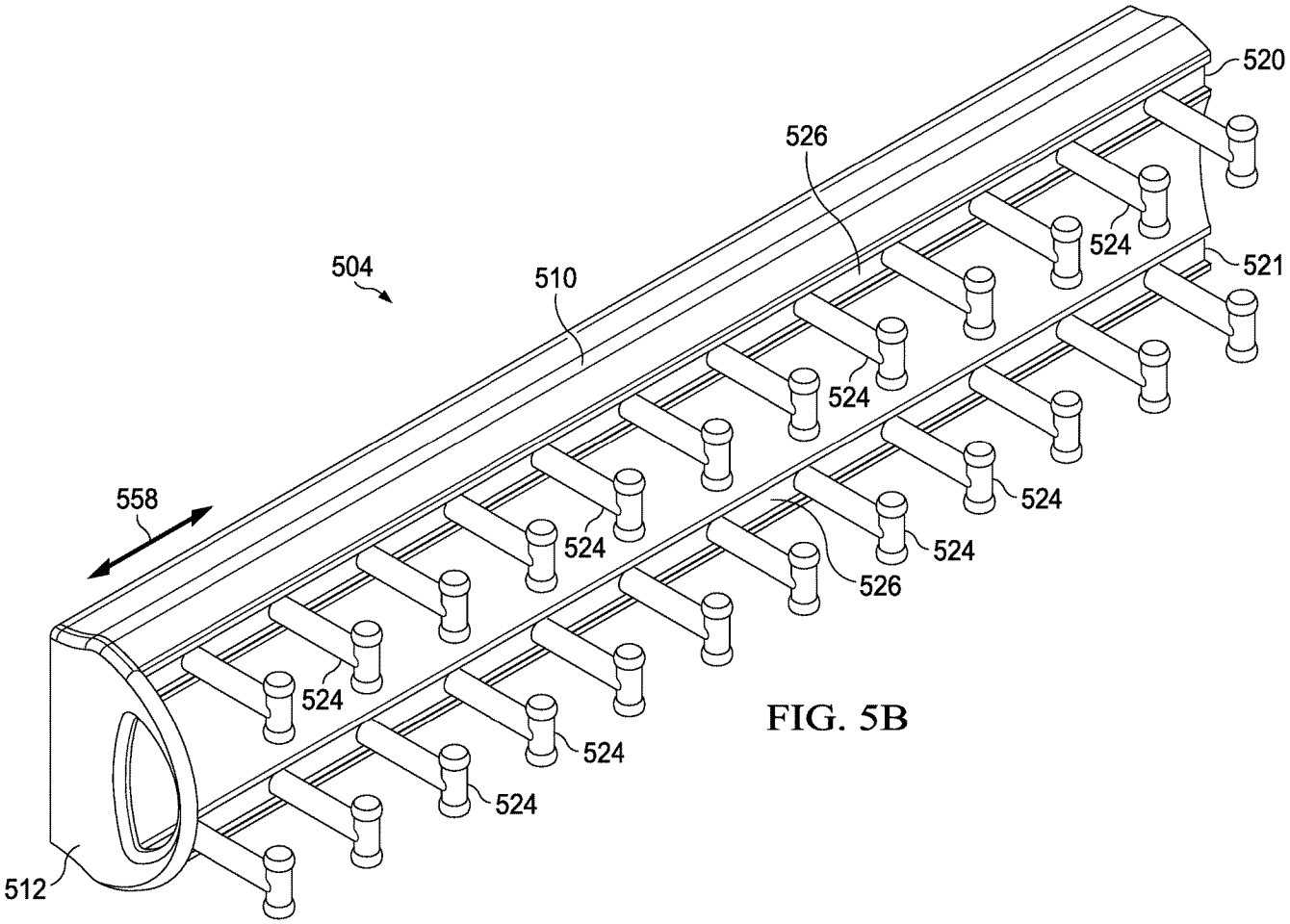
FIG. 5B is an isometric view of a belt rack attached to a slide assembly.
Figure 5C:
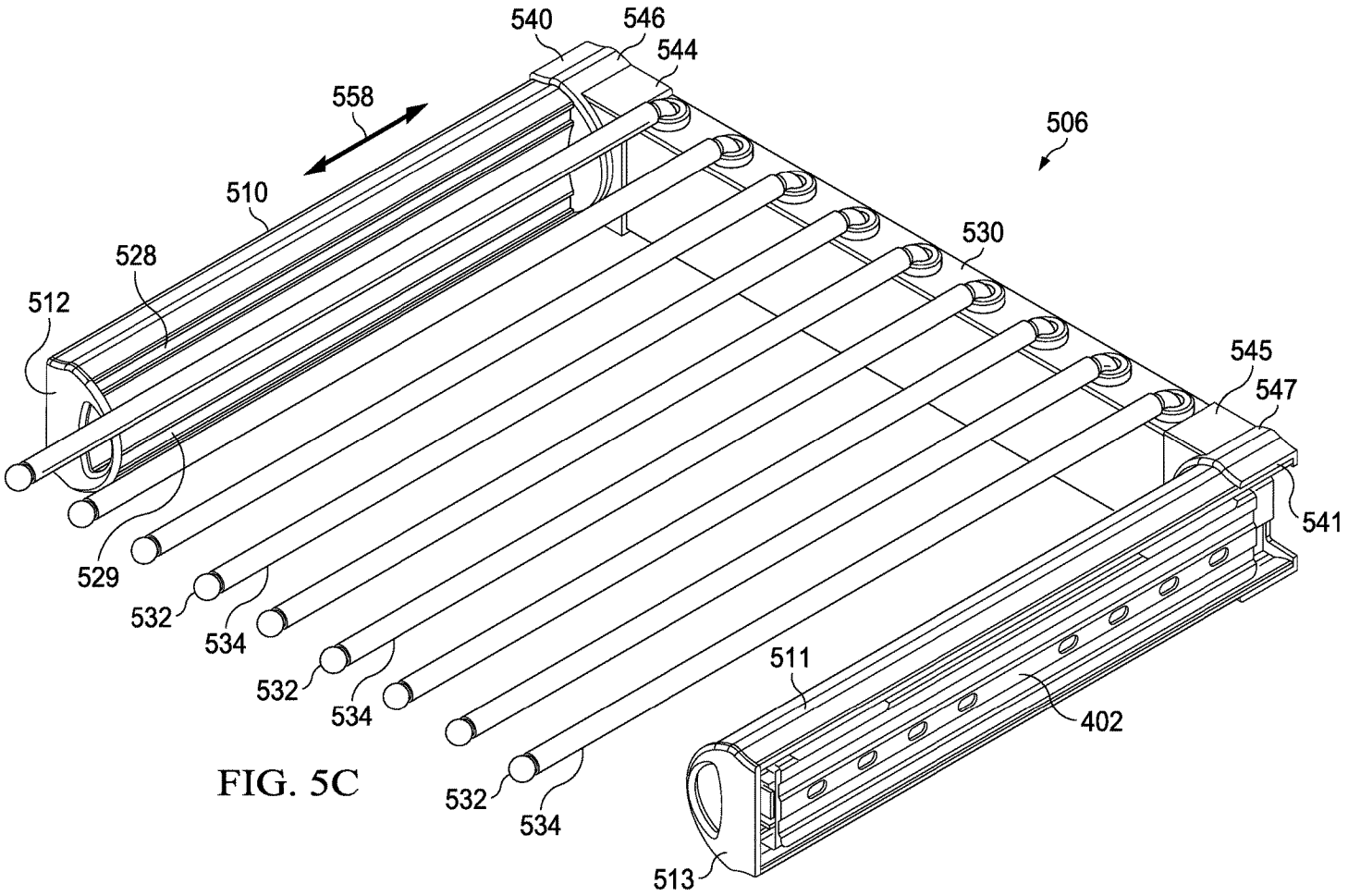
FIG. 5C is an isometric view of a pants rack attached to a pair of slide assemblies.
Figure 5D:
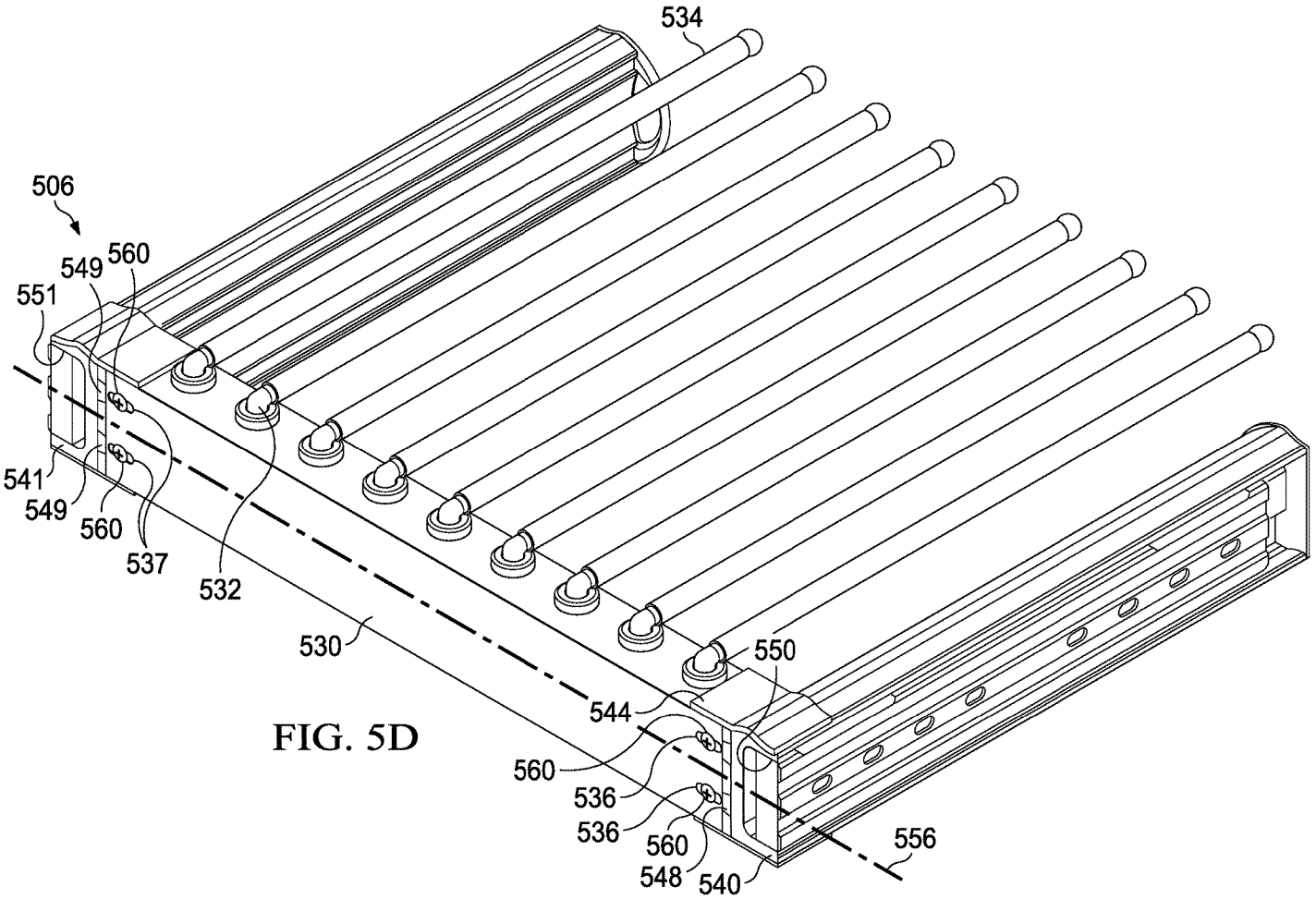
FIG. 5D is a rear isometric view of a pants rack attached to a pair of slide assemblies.

Referring to FIG. 3, bracket 100 is shown positioned for mounting to closet partition 302. Closet partition is a vertical wall of a closet. Prefabricated closet partition 302 is manufactured with pre-drilled mounting holes 304 according to industry standards. Closet partitions are manufactured in many different sizes and therefore include many different pre-drilled mounting hole patterns. Mounting holes 114 in bracket 100 are aligned with pre-drilled mounting holes 304. Mounting hardware such as wood screws are used to secure side 146 of bracket 100 to closet partition 302 through mounting holes 114 and pre-drilled mounting holes 304. Recess 148 allows for the head of the mounting hardware to be flush with ridges 140 and 142 and therefore not interfere with an attached drawer slide assembly.

Figure 4:
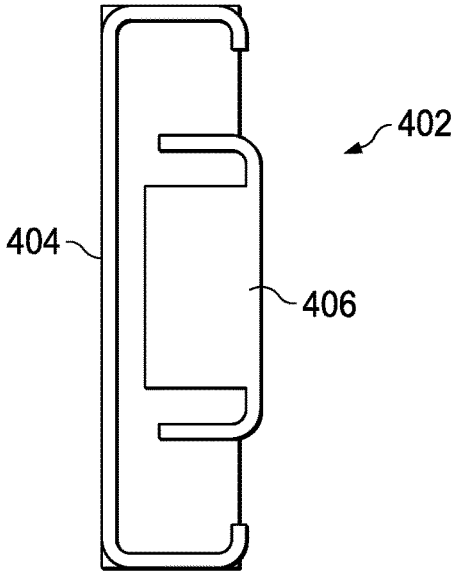
FIG. 4 is an end view of a slide assembly.

FIG. 4 depicts an end view of a slide assembly. Slide assembly 402 is comprised of outer rail 404 slidingly engaged with inner rail 406. In an alternate embodiment, an intermediate rail may be slidingly engaged with both the outer rail and the inner rail. The slide assembly is a part of a closet organizer component such as a tie rack, a belt rack, or a pants rack which will be described further.

Referring to FIGS. 5A-5D, closet organizer component tie rack 502, belt rack 504, and pants rack 506 are shown. The common parts to each closet organizer component are slide assembly 402, housing 510, and front cap 512. Slide assembly 402, housing 510, and front cap 512 are interchangeable between the different closet organizer components.

Tie rack 502 further includes rails 514 and 515 slidingly engaged with housing 510. Each rail 514 and 515 includes a series of evenly spaced pins 516 extending from shaft 518. Front cap 512 is engaged with housing 510. Tie rack 502 is movable in direction 558 between a stored position within the closet and a deployed position exterior to the closet.

Belt rack 504 further includes rails 520 and 521 slidingly engaged with housing 510. Each rail 520 and 521 includes a series of evenly spaced "T" shaped pins 524 extending from shaft 526. Front cap 512 is engaged with housing 510. Belt rack 504 is movable in direction 558 between a stored position within the closet and a deployed position exterior to the closet.

Pants rack 506 includes two slide assemblies 402, housings 510 and 511, and front caps 512 and 513. Rails 528 and 529 are slidingly engaged with housing 510. Additional rails (not shown) are similarly engaged with housing 511. Front cap 512 is engaged with housing 510 and front cap 513 is engaged with housing 511. Brace 530 extends between housings 510 and 511. Bars 532 extend from and are pivotally engaged with brace 530. Each bar 532 includes sheath 534 to provide a non-slip surface for contact with pants hung thereon. Brace 530 includes mounting slots 536 and 537. The longitudinal axes of mounting slots 536 and 537 are parallel with longitudinal axis 556 of brace 530. Brace 530 is adjustably connected to rear caps 540 and 541 via mounting slots 536 and 537, respectively. Rear cap 540 includes hood section 544 and attachment section 546. Attachment section 546 is shaped to mimic the profile of housing 510 and is connected to housing 510. Hood section 544 defines stanchions 548 aligned with mounting slots 536. Rear cap 540 further defines cutout 550 sized to allow passage of bracket 100 and outer rail 404. Rear cap 541 includes hood section 545 and attachment section 547. Attachment section 547 is shaped to mimic the profile of housing 511 and is connected to housing 511. Hood section 545 defines stanchions 549 aligned with mounting slots 537. Rear cap 541 further defines cutout 551 sized to allow passage of bracket 100 and outer rail 404. Connecting hardware 560 such as screws or rivets are used to connect brace 530 to the rear caps through mounting slots 536 and 537 and stanchions 548 and 549. Pants rack 506 is movable in direction 558 between a stored position within the closet and a deployed position exterior to the closet.

Figure 6A:
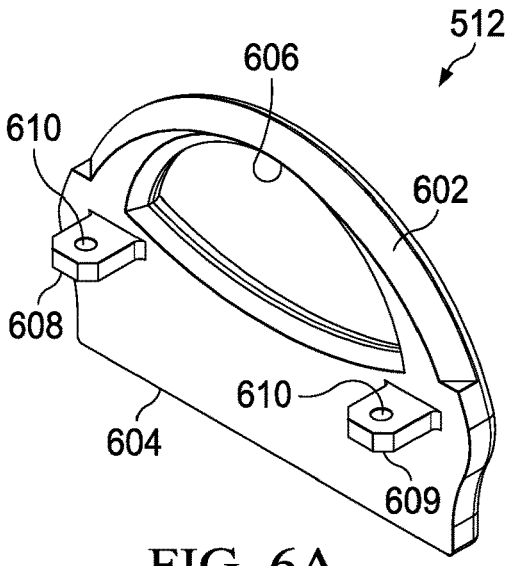
FIG. 6A is an isometric view of a universal front cap for closet organizer components.
Figure 6B:
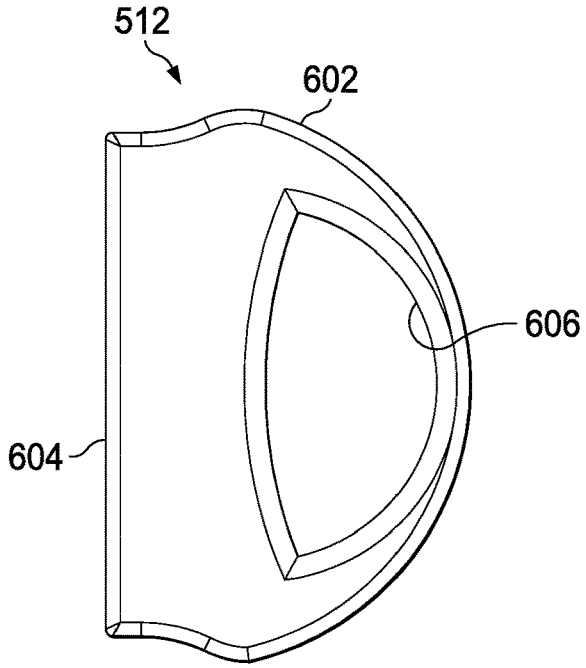
FIG. 6B is an end view of a universal front cap for closet organizer components.

Referring to FIGS. 6A and 6B, front cap 512 is generally semicircular shaped having curved edge 602 and straight edge 604. Front cap 512 is generally planar and includes a semicircular shaped cutout 606. Cutout 606 is sized to use as a handle. Tabs 608 and 609 extend generally perpendicularly from one side of front cap 512. Tabs 608 and 609 include mounting holes 610. Front cap 513 is configured exactly as front cap 512 and will not be described further.

Figure 7:
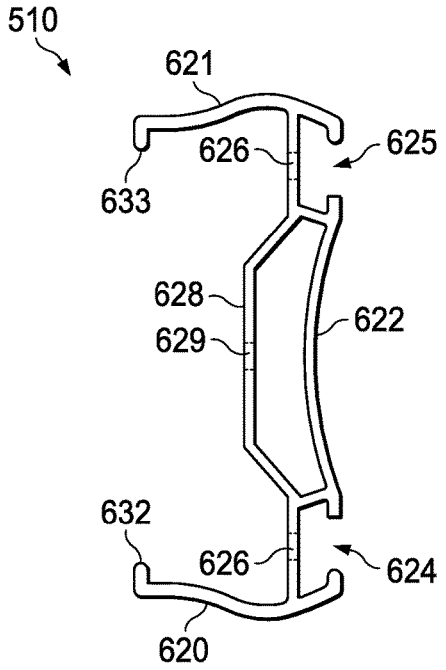
FIG. 7 is an end view of a universal housing for closet organizer components.

Referring to FIG. 7, housing 510 is a generally extruded channel having a length proximate to the length of bracket 100. Housing 510 includes middle portion 622 connected between sides 620 and 621. Middle portion 622 defines slots 624 and 625 proximate sides 621 and 622, respectively.

Slots 624 and 625 include a series of aligned mounting holes 626. Mounting holes 626 are positioned proximate the ends of housing 510. Slots 624 and 625 are sized to receive rails 514, 515, 520, 521, and tabs 608 and 609. Middle portion 622 further includes attachment surface 628. Attachment surface 628 defines a series of aligned mounting holes 629. Mounting holes 629 are positioned proximate the ends of housing 510. Side 620 terminates in hook 632 while side 621 terminates in hook 633. Hooks 632 and 633 engage edges 120 and 122. Housing 511 is configured exactly as housing 510 and will not be described further.

In use, mounting bracket 100 securely and removably attaches a slide assembly to a closet partition for use with closet organizer components. Mounting bracket 100 provides advantages over directly mounting the slide assembly to the closet partition. Mounting bracket 100 includes a set of mounting holes 114 capable of aligning with the pre-drilled mounting holes 304 of a range of closet sizes. The slide assembly is easily "snapped" in and out of engagement with bracket 100 instead of being mounted directly to the closet partition. Further, mounting holes provided on standard slide assemblies often do not align with the pre-drilled mounting holes of common closet partitions requiring an installer to drill new holes in the closet partition that match the mounting holes in the slide assembly. The mounting bracket can be universally used with any of the disclosed closet organizer components or others.

Figure 8A:
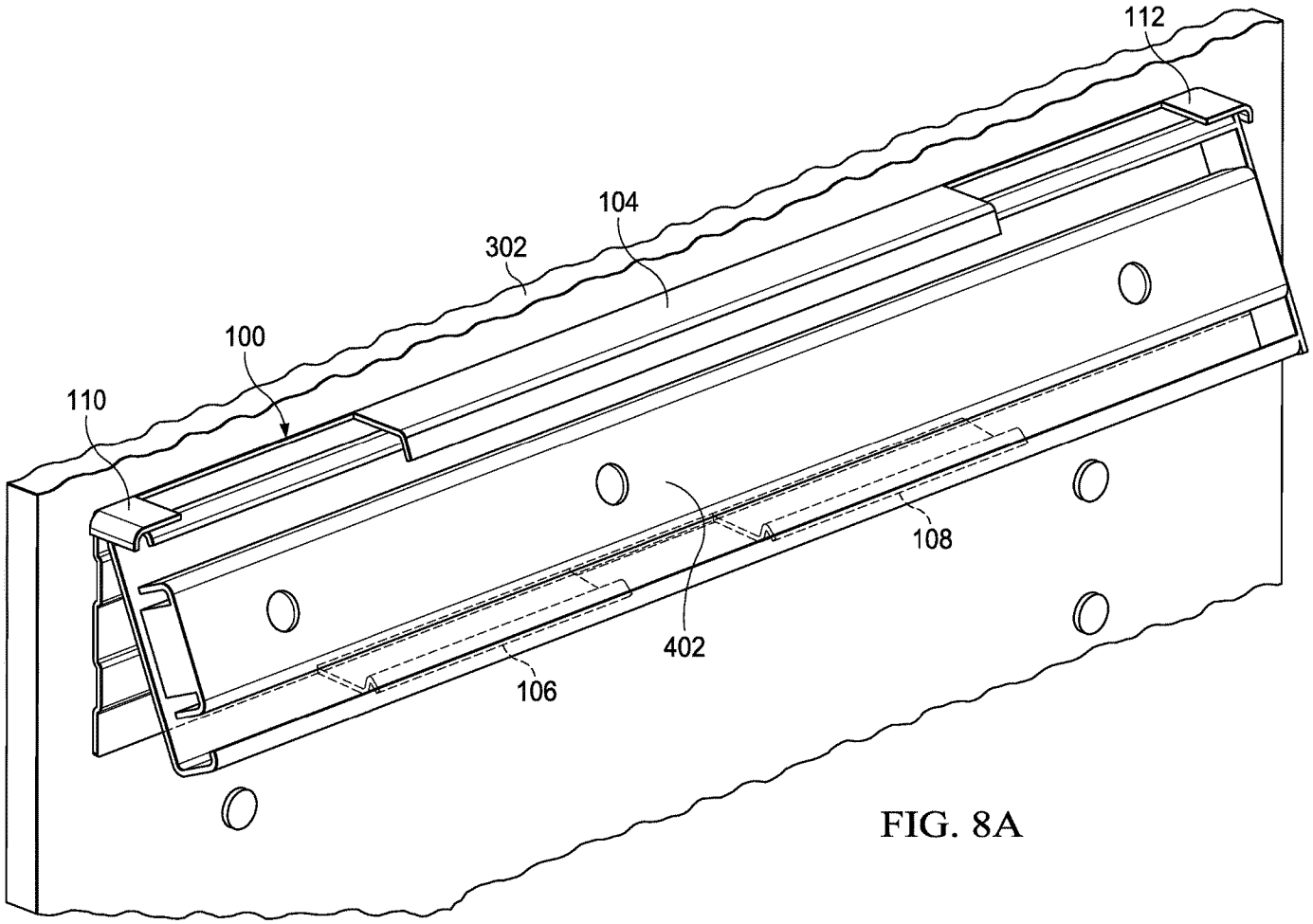
FIG. 8A is an isometric view of a slide assembly partially engaged with a preferred embodiment of a mounting bracket.
Figure 8B:
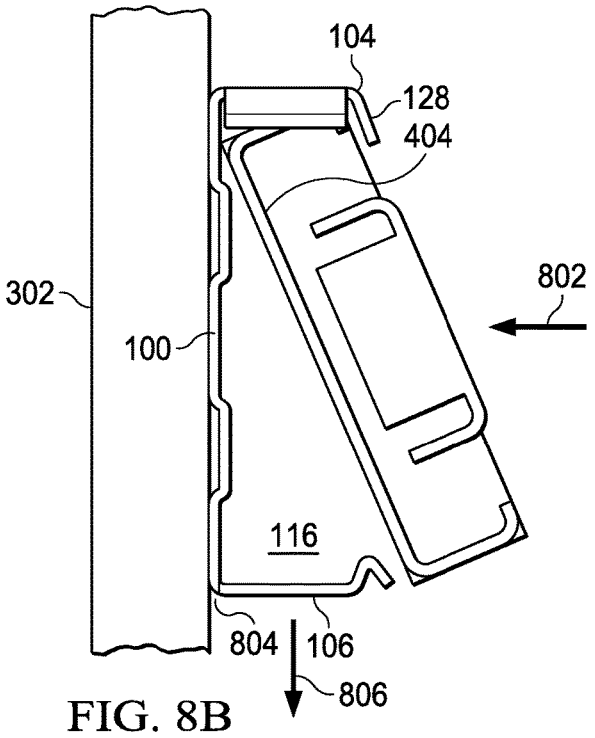
FIG. 8B is an end view of a slide assembly partially engaged with a preferred embodiment of a mounting bracket.

Referring to FIGS. 8A and 8B, drawer slide assembly 402 is attached to mounting bracket 100 by placing drawer slide assembly 402 within interior 116 such that the upper edge of outer rail 404 simultaneously abuts side 144, guide flange 104, and end flanges 110 and 112. The upper edge of outer rail 404 is behind hook 128 and the lower edge of outer rail 404 contacts abutment surfaces 150 and 151. A force in direction 802 urges spring flanges 106 and 108 to resiliently deform about pivot point 804 in direction 806. Spring flanges 106 and 108 continue to deflect in direction 806 until the lower edge of outer rail 404 passes bent sections 130 and 132. Once outer rail 404 passes bent sections 130 and 132, spring flanges 106 and 108 return to generally perpendicular to web 102.

Figure 9B:
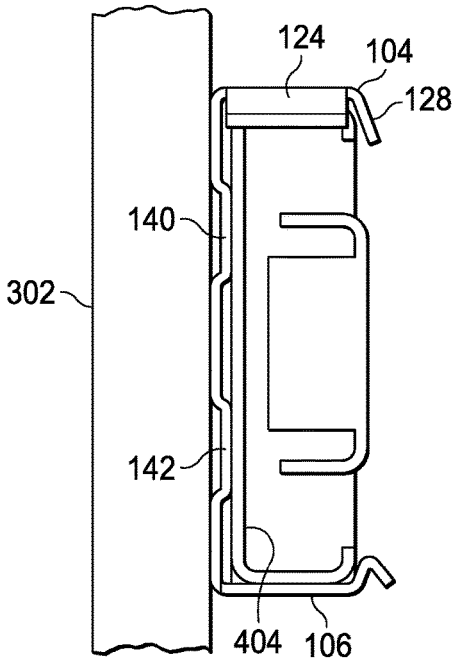
FIG. 9B is an end view of a slide assembly engaged with a preferred embodiment of a mounting bracket.
Figure 9A:
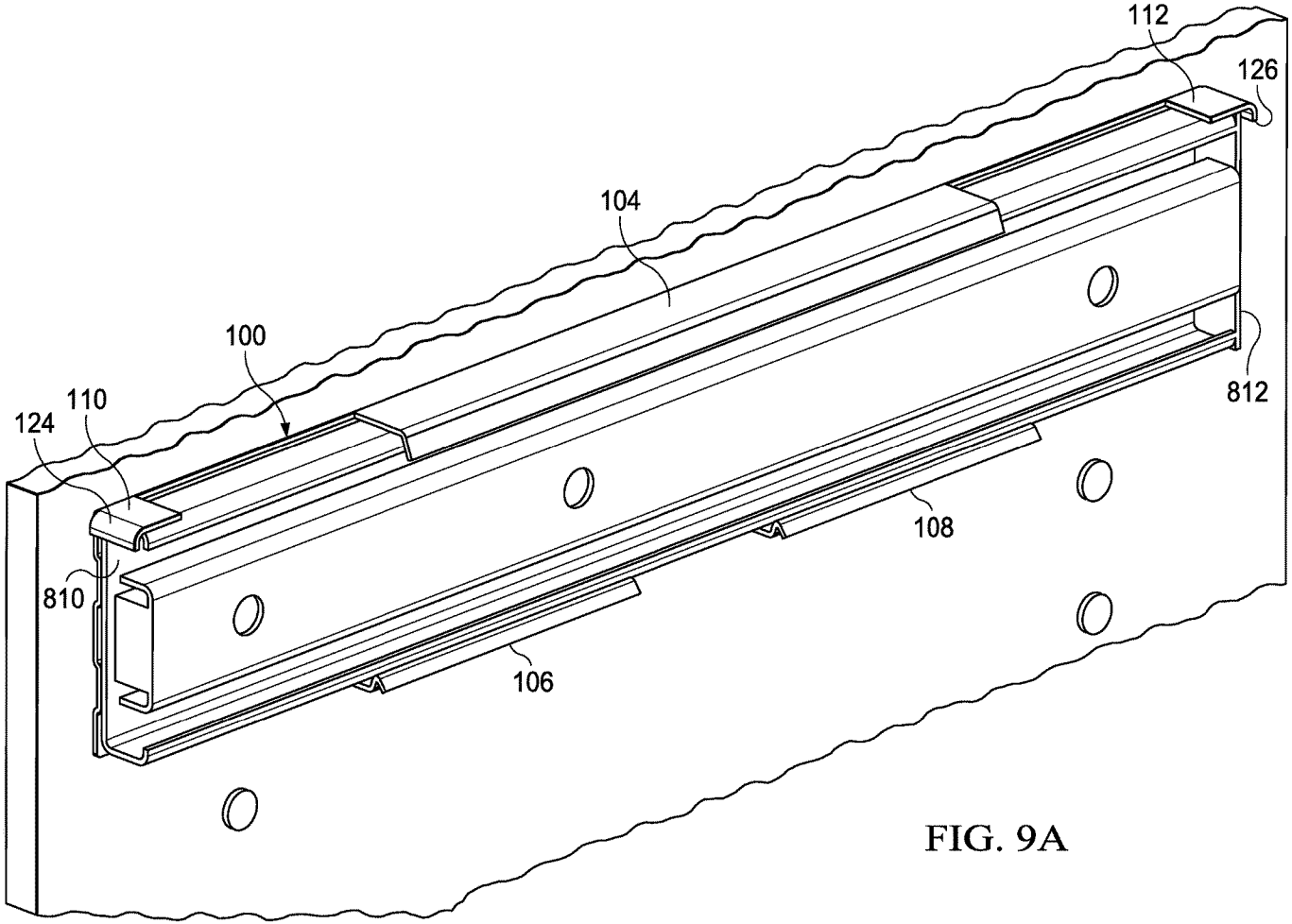
FIG. 9A is an isometric view of a slide assembly engaged with a preferred embodiment of a mounting bracket.

As shown in FIGS. 9A and 9B, drawer slide assembly 402 is securely attached to bracket 100. Outer rail 404 is simultaneously adjacent ridges 140 and 142, guide flange 104, and spring flanges 106 and 108. End 810 of outer rail 404 abuts hook 124 while end 812 of outer rail 404 abuts hook 126. Outer rail 404 further abuts hook 128 and holding surfaces 152 and 153. The spring tension of spring flanges 106 and 108 hold the slide assembly in place within the mounting bracket and prevent rotation of the slide assembly about longitudinal axis 154. The spring tension of spring flanges 106 and 108 along with hooks 124 and 126 prevent longitudinal movement of the slide assembly along longitudinal axis 154.

Figure 10:
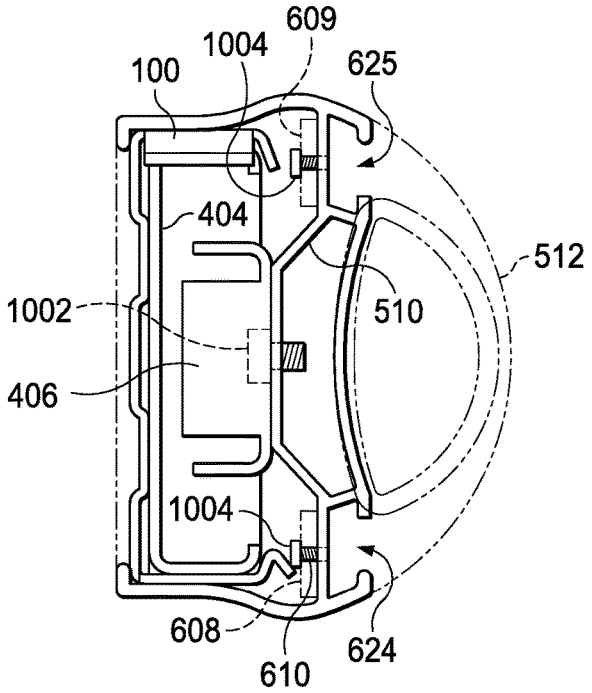
FIG. 10 is a cross-section view of a slide assembly attached to a universal housing and front end cover for closet organizer components.

As shown in FIG. 10, slide assembly 402 snaps into bracket 100. Housing 510 is attached inner rail 406 via connecting hardware 1002 through mounting holes 629. Tabs 608 and 609 are engaged with slots 624 and 625, respectively. Connecting hardware 1004 secure the tabs within the slots through mounting holes 610 and 626. Connecting hardware 1002 and 1004 are common in the art such as screws, rivets, or nuts and bolts. In alternate embodiments, adhesive could be used. The assembly shown in FIG. 10 is applicable to tie rack 502, belt rack 504, and pants rack 506. Housing 511 and front cap 513 attached to slide assembly 402 is configured similarly and will not be described further.

Figure 11:
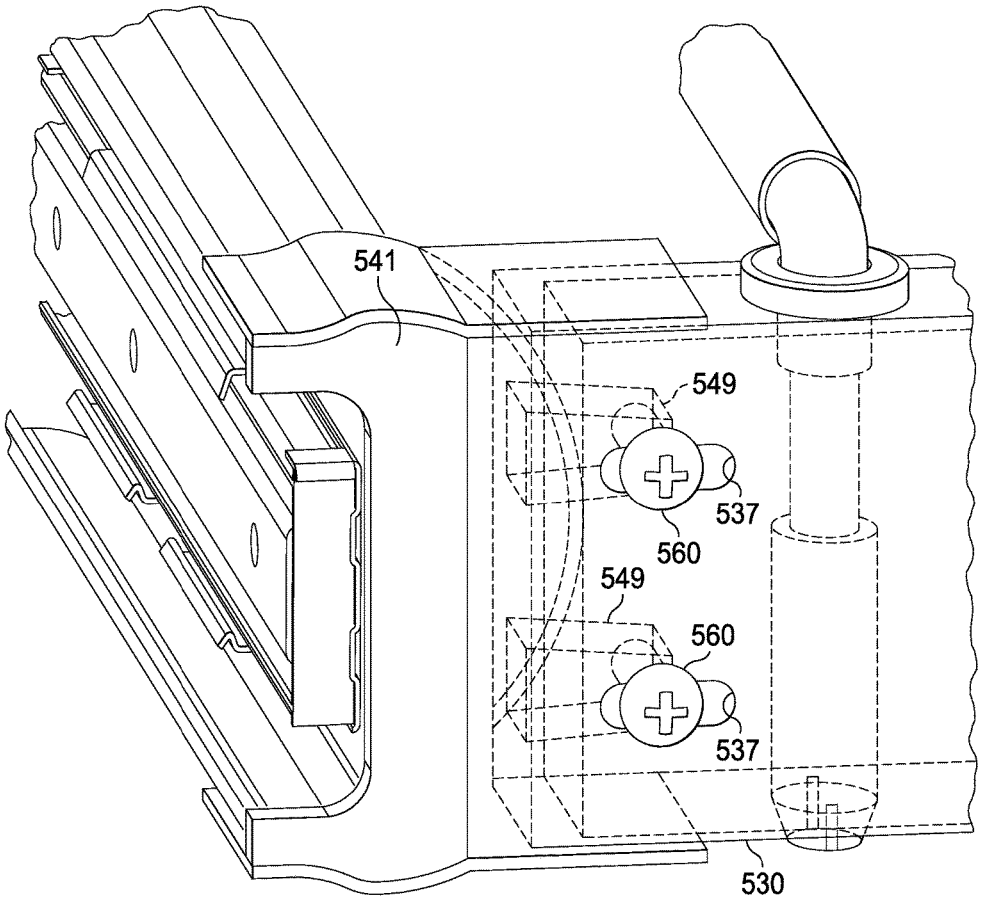
FIG. 11 is a partial isometric view of a brace attached to a universal housing for a pants rack.

As shown in FIG. 11, the spacing between housings 510 and 511 of pants rack 506 can be adjusted. Connecting hardware 560 is loosened within stanchions 549 and mounting slots 537. Brace 530 is moved in either direction along longitudinal axis 556 until the desired spacing is achieved. Moving brace 530 causes connecting hardware 560 to move along the length of mounting slots 537. The adjustment can also be performed on the opposite end of brace 530 with connecting hardware 560 in stanchions 548 and mounting slots 536. No matter the spacing chosen, hood sections 544 and 545 conceal the ends of brace 530 to give the appearance of one solid piece extending between housings 510 and 511.

After attaching the mounting bracket to the closet partition, snapping the slide assembly into engagement with the mounting bracket, and attaching the tie rack 502, belt rack 504, or pants rack 506 to the slide assembly, the tie rack 502, belt rack 504, or pants rack 506 is slidable in direction 558 between a stored position within the closet and a deployed position exterior to the closet. Front caps 512 and 513 can be used as a handle to facilitate the deploying and storing movement.

Figure 12:
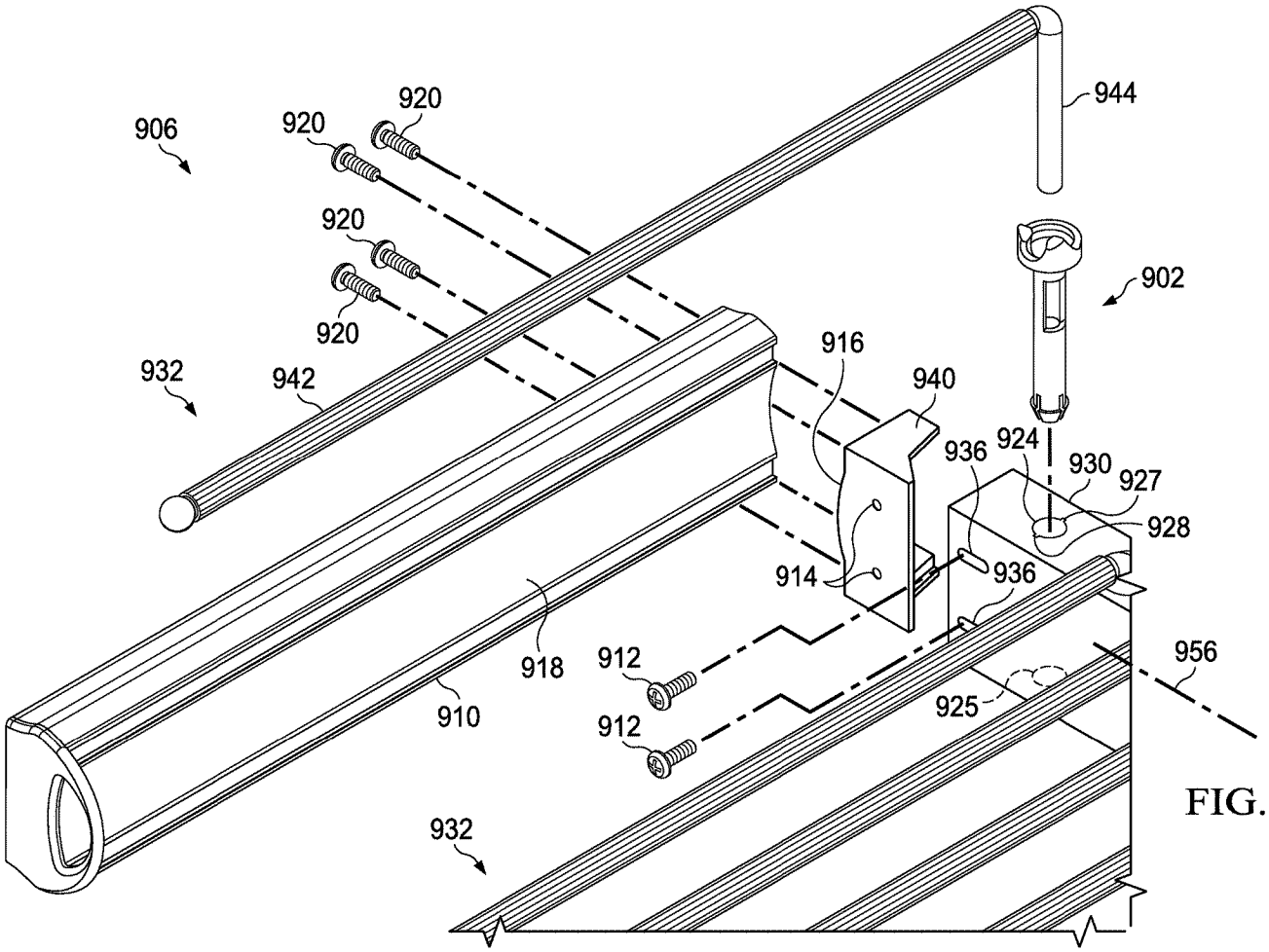
FIG. 12 is a partial, exploded isometric view of an alternate embodiment of a pants rack.

Referring to FIG. 12, in an alternate embodiment, pants rack 906 includes anti-rotation sleeve 902 that prevents bars 932 from freely pivoting with respect to brace 930. Brace 930 includes mounting slots 936. The longitudinal axes of mounting slots 936 are generally parallel with longitudinal axis 956 of brace 930. Brace 930 is adjustably connected to spacer 940 with connecting hardware 912 via mounting holes 914 and mounting slots 936. Spacer 940 is sized to slide within brace 930 and be concealed by brace 930. Spacer 940 includes curved edge 916 which is shaped to match curved surface 918 of housing 910. Spacer 940 is connected to housing 910 with connecting hardware 920. Connecting hardware 912 and 920 can include screws, rivets, or other permanent or semi-permanent fasteners. Pants rack 906 is movable between a stowed position and a deployed position, as previously described.

Brace 930 further includes a series of aligned holes 924. Holes 924 are positioned in the top surface of brace 930. Holes 924 include two diametrically opposed slots 927 and 928. Holes 925 are positioned on the bottom surface of brace 930. Holes 925 are equal in size to and coaxial with holes 924. A set of anti-rotation sleeves are inserted in each hole 924 and 925.

Bar 932 is generally L-shaped and includes hanger section 942 connected to pivot section 944. Pivot section 944 of bar 932 is seated within anti-rotation sleeve 902. A bar 932 is engaged with each anti-rotation sleeve 902.

Figure 13A:
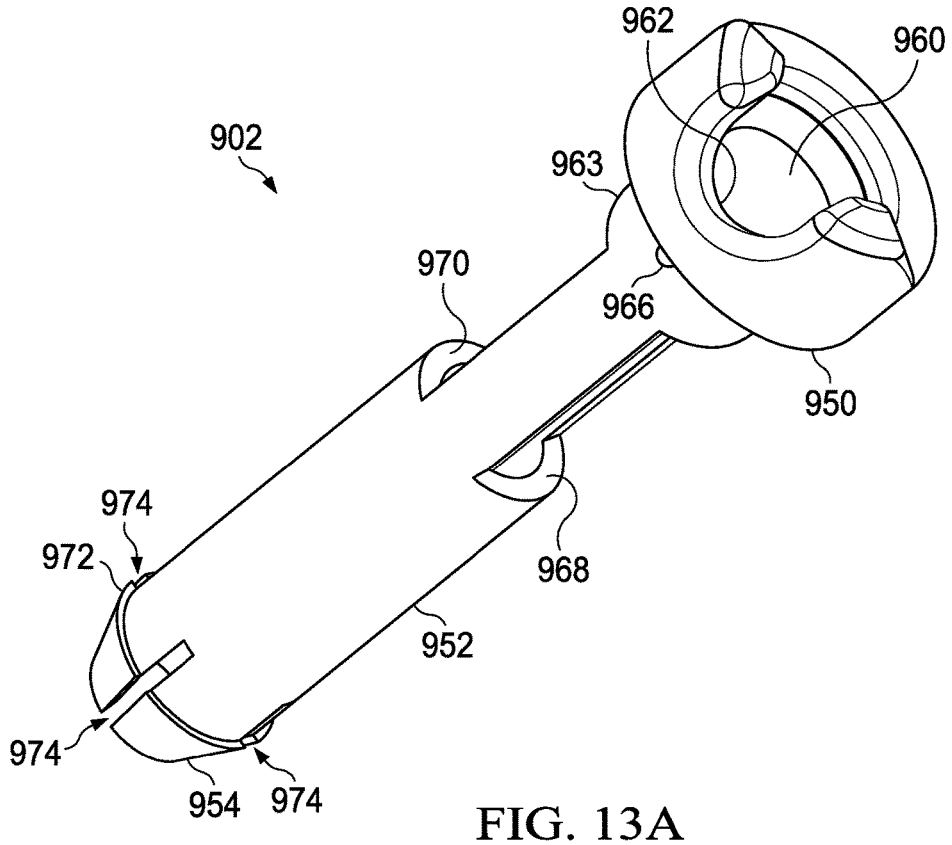
FIG. 13A is an isometric view of an anti-rotation sleeve of an alternate embodiment of a pants rack.
Figure 13B:
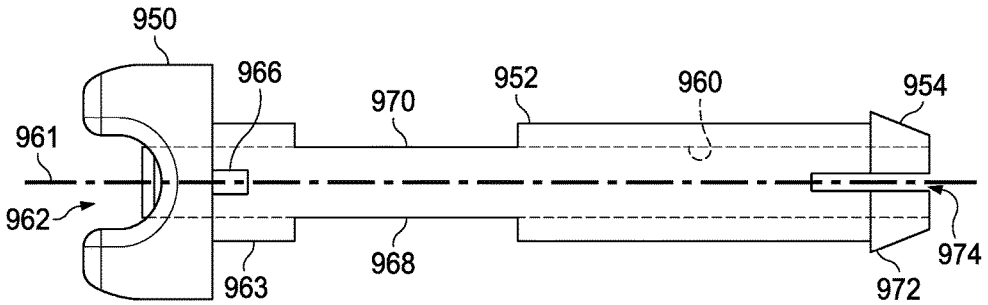
FIG. 13B is a side view of an anti-rotation sleeve of an alternate embodiment of a pants rack
Figure 13C:
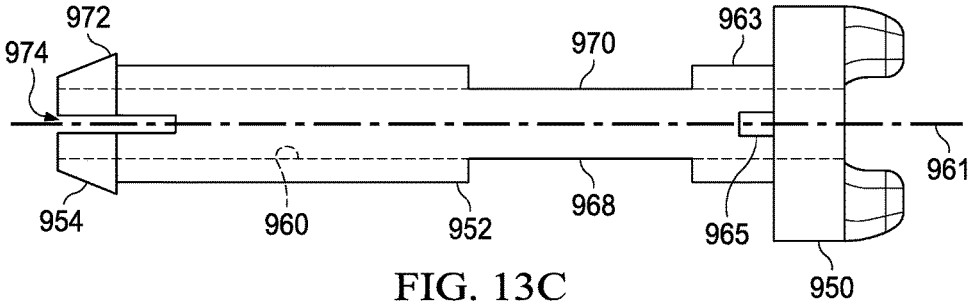
FIG. 13C is a side view of an anti-rotation sleeve of an alternate embodiment of a pants rack.

Referring to FIGS. 13A-C, anti-rotation sleeve 902 is shown. Anti-rotation sleeve 902 is generally cylindrical. Anti-rotation sleeve 902 includes head 950, collar 963, body 952, and retainer 954. Head 950 is connected to and integrally formed with body 952. Body 952 is connected to and integrally formed with retainer 954. Anti-rotation sleeve 902 includes axial hole 960 which passes through and is concentrically aligned with head 950, body 952, and retainer 954, along axis 961.

Head 950 has a diameter that is generally greater than the diameter of body 952. Head 950 defines saddle 962. Saddle 962 is positioned so that its horizontal axis generally intersects and is perpendicular to axis 961. Diametrically opposed tabs 965 and 966 extend radially from collar 963. Tabs 965 and 966 are sized to engage slots 927 and 928, respectively. Body 952 includes radially opposed cutouts 968 and 970. Body 952 includes frustoconical retainer 954. Retainer 954 includes lip 972. Lip 972 has a diameter that is slightly greater than the diameter of body 952. Retainer 954 further includes four gaps 974 spaced at 90° intervals. Gaps 974 allow retainer 954 to deform and pass through hole 924 and hole 925.

When anti-rotation sleeve 902 is seated in brace 930, head 950 extends above the upper surface of brace 930 and hole 924. Retainer 954 extends below the lower surface of brace 930 and through hole 925. Lip 972 secures anti-rotation sleeve 902 in hole 925. Tabs 965 and 966 engage cutouts 927 and 928, and prevent rotation of anti-rotation sleeve 902 with respect to brace 930. To prevent rotation of bar 932 with respect to brace 930, pivot section 944 engages hole 960 and hanger section 942 rests in saddle 962. Rotation of bar 932 with respect to brace 930 is possible when bar 932 is lifted such that hanger section 942 disengages from saddle 962 while pivot section 944 remains engaged with hole 960. When hanger section 942 is disengaged from saddle 962, bar 932 is free to rotate with respect to brace 930 about the longitudinal axis of pivot section 944.

It will be appreciated by those skilled in the art that changes could be made to the embodiments described above without departing from the broad inventive concept. It is understood, therefore, that this disclosure is not limited to the particular embodiments herein, but it is intended to cover modifications within the spirit and scope of the present disclosure as defined by the appended claims.

The invention claimed is:

1. A pants rack for slidable deployment from a closet comprising:
- a first slide assembly configured to be mounted to the closet;
- a second slide assembly configured to be mounted to the closet;
- a first housing rigidly attached to the first slide assembly and a second housing rigidly attached to the second slide assembly;
- a brace adjustably connected to the first housing and the second housing;
- a sleeve, defining a saddle, fixed with respect to the brace;
- a bar slidably engaged with the sleeve and seated in the saddle;
- wherein the first housing and the second housing are simultaneously movable between a stored position within the closet and a deployed position exterior to the closet,
- wherein the sleeve includes:
  - a head connected to a body and a retainer connected to the body; and,
  - a tab extending from the head and engaged with the brace.

2. The pants rack of claim 1 wherein the bar is fixed with respect to the sleeve.

3. The pants rack of claim 1 wherein the bar further comprises:
- a hanger section connected to a pivot section; and,
- wherein the pivot section is slidably engaged with the sleeve and the hanger section extends from the brace generally parallel with the first housing and the second housing.

4. The pants rack of claim 1 further comprising:
- a first spacer adjustably connected to the brace and fixed to the first housing; and,
- a second spacer adjustably connected to the brace and fixed to the second housing.

5. The pants rack of claim 1 wherein the sleeve further comprises:
- the saddle formed in the head.

6. The pants rack of claim 1 wherein the sleeve further comprises:
- a lip extending from the retainer and adjacent the brace.

7. The pants rack of claim 1 further comprising:
- a first snap-in mounting bracket configured to be rigidly affixed to the closet, wherein the first sliding assembly is removably engaged with the first snap-in mounting bracket; and,
- a second snap-in mounting bracket configured to be rigidly affixed to the closet, wherein the second sliding assembly is removably engaged with the second snap-in mounting bracket.

8. The pants rack of claim 1 further comprising a plurality of sleeves seated in the brace and a bar of a plurality of bars slidingly seated within each sleeve of the plurality of sleeves.

9. In a device for the slidable deployment of a pants rack from a closet comprising a first housing and a second housing adjustably connected to a brace, a set of cylindrical sleeves attached to the brace, and a set of bars extending from the set of sleeves wherein each sleeve of the set of sleeves prevents rotation of a bar of the set of bars relative to the brace, a method for assembling the device, the method comprising:
- mounting the first and second housings to the closet;
- fixing the set of cylindrical sleeves with respect to the brace;
- slidingly engaging the set of bars with the set of sleeves;
- seating each bar from the set of bars in a saddle of each sleeve from the set of sleeves; and
- engaging a tab extending from a head of the sleeve connected to a body of the sleeve with the brace.

10. The method of claim 9 wherein the mounting step further comprises:
- mounting a first snap-in bracket and a second snap-in bracket to the closet;
- engaging the first housing with the first snap-in bracket; and,
- engaging the second housing with the second snap-in bracket.

11. The method of claim 9 wherein the mounting step further comprises:
- mounting a first snap-in bracket and a second snap-in bracket to the closet;
- engaging a first slide assembly with the first snap-in bracket;
- engaging a second slide assembly with the second snap-in bracket;
- attaching the first housing to the first slide assembly; and,
- attaching the second housing to the second slide assembly.

12. A pants rack for slidable deployment from a closet comprising: a first housing and a second housing;
- a snap-in mounting bracket for mounting the first housing or the second housing that includes:
  - a guide flange extending from a web;
  - a set of spring flanges extending from the web and opposing the guide flange;
  - a set of end flanges extending from web proximate the guide flange;
  - a plurality of mounting holes in the web;
- a brace adjustably connected to the first housing and the second housing;
- a sleeve, defining a saddle, fixed with respect to the brace;
- a bar slidably engaged with the sleeve and seated in the saddle;
- wherein the sleeve includes:

a head connected to a body and a retainer connected to the body; and, a tab extending from the head and engaged with the brace.

13. The pants rack of claim 12 wherein the snap-in mounting bracket further comprises:

a first hook extending from the guide flange;

a second hook extending from a first end flange of the set of end flanges; and, a third hook extending from a second end flange of the set of end flanges.

14. The pants rack of claim 12 wherein each spring flange of the set of spring flanges comprises:

an abutment surface oriented at an angle from and connected to a holding surface.

15. The pants rack of claim 14 wherein the angle ranges between 30° and 60°.

16. The pants rack of claim 12 wherein the snap-in mounting bracket further comprises:

each mounting hole of the plurality of mounting holes has a first longitudinal axis;

the web has a second longitudinal axis; and, wherein the first longitudinal axis is parallel with the second longitudinal axis.

17. The pants rack of claim 12 wherein the web further comprises:

a first ridge proximate the guide flange;

a second ridge proximate the set of spring flanges; and, a recess positioned between the first ridge and the second ridge.

18. The pants rack of claim 17 wherein the plurality of mounting holes are positioned in the recess.

19. The pants rack of claim 12 wherein the guide flange and the set of end flanges extend from a first edge of the web and the set of spring flanges extend from a second edge of the web.

20. The pants rack of claim 1 further comprising:

the tab formed on an opposite side of the head from the saddle;

the tab being a first tab and formed on a first side of the body;

a second tab that is formed on a second side of the body that is opposite to the first side of the body;

a first cutout in the body that is on a third side of the body and is a distance away from the head;

a second cutout in the body that is on a fourth side of the body and is the distance away from the head;

the fourth side of the body opposite to the third side of the body; and, each of the first and second sides of the body being adjacent to each of the third and fourth sides of the body.

* * * * *